US005778461A

United States Patent [19]

Attaway

[11] Patent Number: 5,778,461

[45] Date of Patent: Jul. 14, 1998

[54] BEDPAN WITH INTEGRAL URINAL

[76] Inventor: Vesta M. Attaway, 27267 Sleepy Hollow Ave., #105, Hayward, Calif. 94545

[21] Appl. No.: 891,919

[22] Filed: Jul. 14, 1997

[51] Int. Cl.[6] ..... A61G 9/00

[52] U.S. Cl. ..... 4/454; 4/450; 4/457

[58] Field of Search ..... 4/454, 450, 457, 4/451, 452, 453, 455, 456

[56] References Cited

U.S. PATENT DOCUMENTS 1,400,074 12/1921 Karrakis ..... 4/454

1,642,255 9/1927 Lowenstein ..... 4/454

FOREIGN PATENT DOCUMENTS 4971 12/1904 United Kingdom ..... 4/454

4490 1/1915 United Kingdom ..... 4/454

*Primary Examiner*—David J. Walczak

*Attorney, Agent, or Firm*—Linval B. Castle

[57] ABSTRACT

A conventional bedpan having sidewalls topped by an outwardly curved seat contains, in the forward end, a cabinet with a wall opening into the bedpan and containing a large extendible tube which may be withdrawn to function as a urinal for male patients.

3 Claims, 2 Drawing Sheets

BEDPAN WITH INTEGRAL URINAL

This invention relates to hospital supplies and in particular to a bedpan with a flexible tube which becomes a male urinal located in a housing a the narrow end of the pan.

BRIEF SUMMARY OF THE INVENTION

Bedpans are distasteful but necessary hospital utensils that are slipped under prone bedridden patients. They have a flat bottom and are oval in shape with a smooth curved seat portion along the top. The older models were formed of steel and the seats curved inwardly from the side edge of the pan leaving a section at the front of the pan without the inwardly curved seat through which the bedpan was cleaned. The more modern bedpans are formed of plastic and the seats curve outward from the side edges of the pan.

Male patients using the conventional bedpan often have difficulties because they often require the simultaneous use of a separate urinal. The bedpan of the invention provides the urinal in a convenient position as an integral part of the bedpan.

Briefly described, the bedpan of the invention is of the modern plastic type with the outward turning seat and with a small cabinet in the front end with a top door from which a extendible plastic tube may be withdrawn to become a urinal. The tube drains into the bedpan.

DESCRIPTION OF THE DRAWINGS

In the drawings which illustrate a preferred embodiment of the invention.

DETAILED DESCRIPTION OF THE PREFERRED EMBODIMENT

Figure 1:
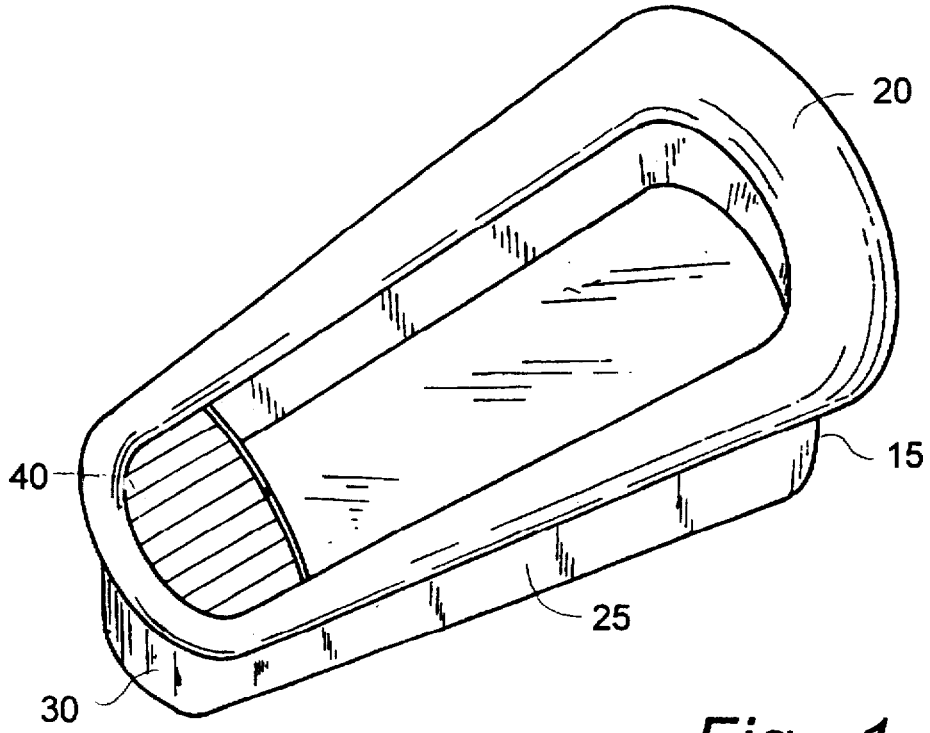
FIG. 1 is a perspective view of the bedpan of the invention.
Figure 2:
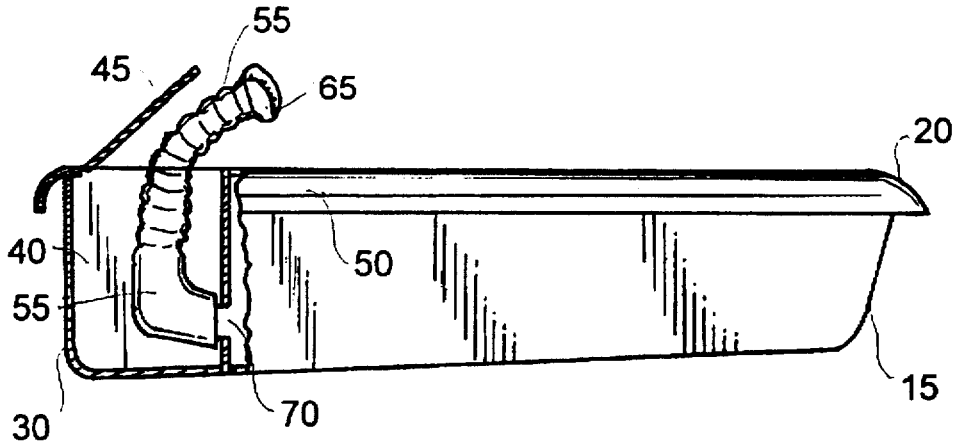
FIG. 2 is an elevational view of the bedpan showing the cabinet door open and the tube extended.

As illustrated in FIG. 1, the bedpan is comprised of a back end 15, an opposite front end 30 and slanted sidewalls 25 topped by an outwardly curved top flange or seat 20. In the front end 30 of the bedpan is an enclosed cabinet 40 with a hinged top 45 and within the cabinet is a flexible plastic tube 55, as best illustrated in the elevational view of FIG. 2.

The flexible tube 55 has a large diameter, is extendible and has an enlarged funnel-shaped inlet end 65 so that it functions as a urinal for male patients. The tube 55 extends through the cabinet 40 and it's lower end 70 is attached to an opening in the wall common to the cabinet 40 and the interior of the bedpan. When not in use tube 55 is stored completely within the cabinet 40 with the hinged top 45 shut and locked with an appropriate catch.

Figure 3:
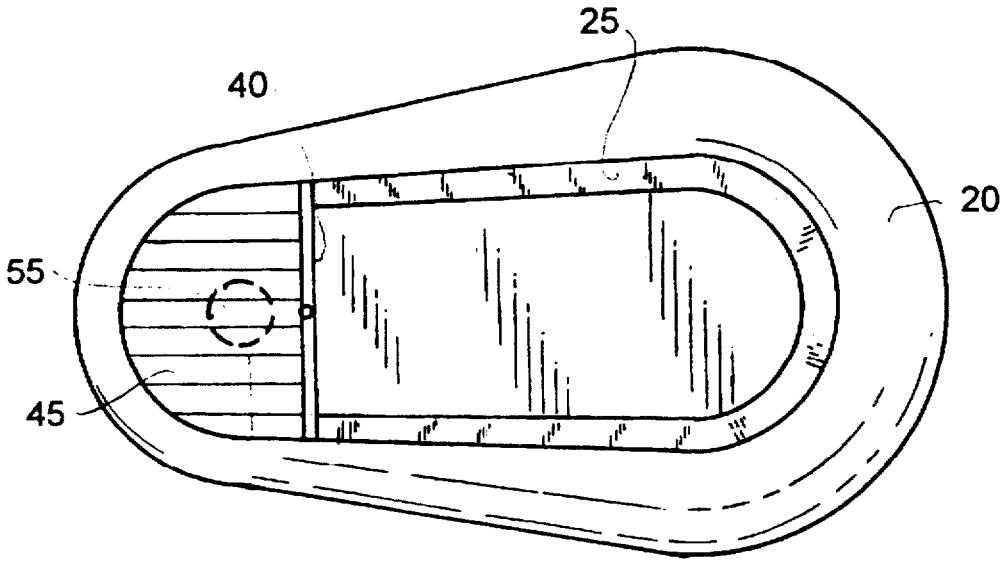
FIG. 3 is a plan view of the bedpan.

FIG. 3 is a plan view showing, by broken lines, the flexible tube 55 stored under the covering hinged top 45 of the cabinet 40.

I claim:

1. A bedpan with incorporated urinal for male patients, said bedpan formed with front and rear ends connected by sidewalls topped by an outward curved seat, said bedpan comprising:

an enclosed cabinet in the front end of said bedpan, said cabinet having a top and a common wall with the interior of said bedpan, said common wall having an opening into said bedpan; and a flexible tube within said cabinet, said tube having a first end extendible from said top and a second end attached to said common wall and to said opening.

2. The bedpan claimed in claim 1 wherein said first end of said tube has an enlarged funnel-shaped diameter.

3. The bedpan claimed in claim 1 wherein the top of said cabinet is covered by a door.

* * * * *